United States Patent [19]

Sonnenmoser et al.

[11] Patent Number: 4,903,667

[45] Date of Patent: Feb. 27, 1990

[54] PRESSURE REGULATING VALVE

[75] Inventors: Alfred Sonnenmoser; Klaus Matthiesen, both of Blaichach, Fed. Rep. of Germany

[73] Assignee: Robert Bosch GmbH, Stuttgart, Fed. Rep. of Germany

[21] Appl. No.: 293,286

[22] Filed: Jan. 4, 1989

[30] Foreign Application Priority Data

Feb. 12, 1988 [DE] Fed. Rep. of Germany ... 8801816[U]

[51] Int. Cl.[4] ..... F02M 39/00

[52] U.S. Cl. ..... 123/463; 123/456; 123/467

[58] Field of Search ..... 123/463, 456, 467, 446, 123/447, 468, 469; 137/510; 251/356, 357, 88

[56] References Cited

U.S. PATENT DOCUMENTS

| | | | |
|---|---|---|---|
| 4,064,855 | 12/1977 | Johnson | 123/467 |
| 4,357,921 | 11/1983 | Ciaccio | 123/463 |
| 4,615,320 | 10/1986 | Fehrenbach | 123/467 |
| 4,633,901 | 1/1987 | Brandt | 123/463 |
| 4,741,315 | 5/1988 | Fehrenbach | 123/463 |
| 4,756,289 | 7/1988 | Rock | 123/463 |

*Primary Examiner*—Carl Stuart Miller
*Attorney, Agent, or Firm*—Edwin E. Greigg

[57] ABSTRACT

A pressure regulating apparatus which serves to regulate fuel pressure in a fuel injection system for internal combustion engines. The pressure regulating apparatus includes a pressure regulating valve, which has a valve diaphragm fastened in a valve housing and defining a fuel chamber, which communicates via an inlet conduit with a fuel distributor line. Protruding into the fuel chamber is a valve seat carrier body having a valve seat body, on which a valve seat is embodied, from which an outlet conduit leads to an outlet fitting. The pressure regulating valve is inserted into a holder bushing communicating with the fuel distributor line and is sealed off therefrom by a sealing ring disposed on the regulating valve. The axial fixation of the pressure regulating valve in the holder bushing is effected via a screw connection with a retaining body.

9 Claims, 1 Drawing Sheet

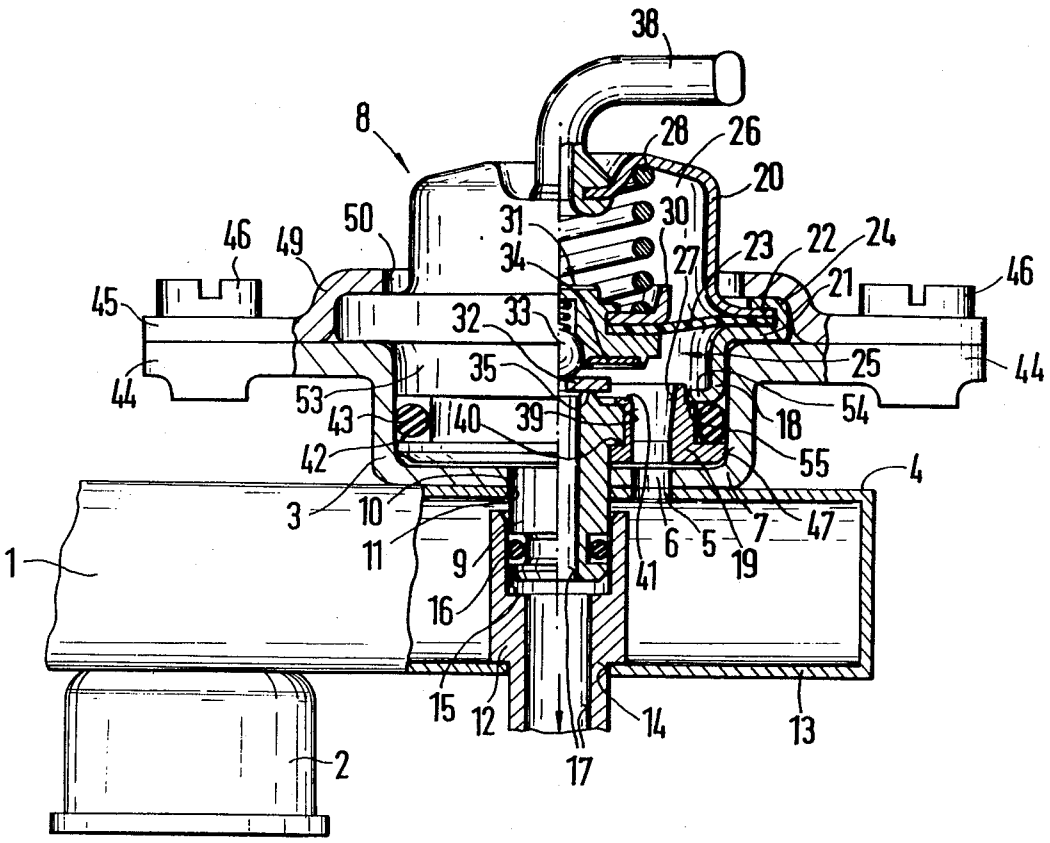
46
44
24
22
21
25
54
4
55
47
13
20
26
23
18
7
19
38
28
30
27
5
6
41
14
17
31
34
33
39
32
35
40
9
16
12
15
8
50
10
11
43
42
3
2
49
53
46
45
44
1

PRESSURE REGULATING VALVE

BACKGROUND OF THE INVENTION

The invention is based on a pressure regulating valve of the type defined hereinafter. In a known pressure regulating valve, Pat. No. 4,741,315, issued May 3, 1988, the valve housing is embodied by a cap and a bottom part, each made of sheet metal and formed as a deep-drawn part, and an outlet fitting is introduced into the bottom part in a pressure-tight manner. This has the disadvantage of a certain dimensional instability on the part of the valve housing, causing the outlet fitting provided with the valve seat to swing outward which changes the opening characteristic of the valve, or even renders the valve useless.

OBJECT AND SUMMARY OF THE INVENTION

The pressure regulating valve has an advantage over the prior art that the bottom part that receives the outlet fitting and the valve seat is rigid, thus lending the valve housing sufficient rigidity to resist dimensional changes; as a result, the capacity of the valve to function as desired is retained over a very long service life.

The provisions recited herein include further advantageous features of the pressure regulating valve. Economical production of the pressure regulating valve is thereby attained, and for a more corrosion-resistant version, the valve can be produced from special steel.

The invention will be better understood and further objects and advantages thereof will become more apparent from the ensuing detailed description of a preferred embodiment taken in conjunction with the drawing.

BRIEF DESCRIPTION OF THE DRAWING

The single figure of the drawing shows a simplified view generally in cross-section of an exemplary embodiment of the pressure regulating valve according to the invention.

DESCRIPTION OF THE PREFERRED EMBODIMENT

In the drawing, a rigid fuel distributor line 1 is shown, for instance manufactured of metal, for a fuel injection system for internal combustion engines. The line 1 has a plurality of plug connections 2, into which separate fuel injection valves are inserted by one end. A cup-shaped receiving bush 3 is joined, for instance by soldering or welding, to the wall of the fuel distributor line 1. The receiving bush 3 may also be formed onto the fuel distributor line and/or may protrude at least partway into the fuel distributor line 1. In the wall 4 of the fuel distributor line 1 oriented toward the receiving bush 3, at least one inlet opening 5, which is flush with a connecting opening 6 in the bottom 7 of the receiving bush 3, is provided. The inlet opening 5 and the connecting opening 6 may also be annular in shape. A pressure regulating valve 8 is introduced into a guide bore 47 of the receiving bush 3 and includes an outlet fitting 9 which protrudes sealingly through a first insertion opening 10 in the bottom of the receiving bush 3 and a second insertion opening 11 in the wall 4 of the fuel distributor line 1 into a receiving bore 15 of a receiving fitting 12. The receiving fitting 12 protrudes into the fuel distributor line 1 and penetrates the opposite wall 13 of the fuel distributor line 1 remote from the pressure regulating valve 8 in an opening 14, in which it is tightly secured, for instance by soldering. Instead of providing the separate insertion openings 10, 11, the inlet opening 5 and the connecting opening 6 may be annular and having a diameter large enough that the outlet fitting 9, while maintaining a sufficiently large flow cross section about its circumference, can be passed through the inlet opening 5 and the connecting opening 6. With its end protruding out of the pressure regulating valve 8, the outlet fitting 9 protrudes into the receiving bore 15 of the receiving fitting 12, and an elastic sealing ring 16 is provided on its circumference for sealing off the outlet fitting from the receiving bore 15. The outlet fitting 9 includes an axial bore which is in axial alignment with an outlet conduit 17 in the receiving fitting 12 which in a manner not shown leads to a fuel tank or to the intake side of a fuel feed pump. The fuel distributor line 1 communicates with a fuel supply line, which is connected to the feed outlet of the fuel feed pump.

The valve housing of the pressure regulating valve 8 is comprised of a bottom part 19, an intermediate part 18 and a cap 20. The bottom part 19 and the intermediate part 18 are inserted into the receiving bush 3. Facing one another, the intermediate part 18 has a shoulder 21 and the cap 20 has a collar 22, between which a resilient valve diaphragm 23 is fastened, by means of a crimped edge 24 adjoining the shoulder 21 and fitting over the collar 22. The valve diaphragm 23 divides a fuel chamber 25 in the bottom part 19 and intermediate part 18 from a spring chamber 26 in the cap. The bottom part 19 is penetrated axially by at least one inflow opening 27, which is flush with the connecting opening 6 in the bush, so that the inlet opening 5, the connecting opening 6 and the inflow opening 27 form an inlet conduit, by way of which fuel can flow from the fuel distributor line 1 into the fuel chamber 25 of the fuel pressure regulator valve 8. A compression spring 28 is disposed in the spring chamber 26, bracing itself at one end on the cap 20 and on the other on a spring plate 30, which is secured to the valve diaphragm 23 by means of a rivet connection 31 extending in a sealed manner through the valve diaphragm 23. The rivet connection 31 has a valve plate 32 that protrudes into the fuel chamber 25 and is supported movably in the rivet connection 31 by means of a ball 33 and a retaining clamp 34. The valve plate 32 is urged by the compression spring 28 in the direction toward a valve seat 35, which is embodied on the end of the outlet fitting 9 that protrudes into the fuel chamber 25 and from which the outlet conduit 17 originates. If the fuel pressure in the fuel distributor line and hence in the fuel chamber 25 rises above a value predetermined by the force of the compression spring 28, then the valve plate 32 is raised from the valve seat 35, and fuel can flow out of the fuel chamber 25 via the outlet conduit 17.

An air connection fitting 38 is secured to the cap 20, and by way of the air connection, through a hose connection, not shown, the spring chamber 26 can be made to communicate with the air intake tube of the engine downstream of a throttle valve or to atmospheric pressure.

The bottom part 19 of the pressure regulating valve has a retaining bore 39, extending in stepped fashion in the axial direction, the outlet fitting 9 is provided with a step or shoulder 40, which is pressed into the retaining bore 39 and retained tightly therein by means of a flanged-over bent rim 41.

A radially open sealing groove 42 is provided on the circumference of the bottom part 19, and a seal, embodied as an elastic sealing ring 43 is disposed in this groove 42 and seals in the radial direction. The receiving bush 3 surrounds the bottom part 19 of the pressure regulating valve 8, in a region leading axially away from the bottom 7, at least completely enough that secure sealing between the bottom part 19 and the receiving bush 3 is assured by the sealing ring 43.

For axial fixation of the pressure regulating valve 8 in the receiving bush 3, the receiving bush 3 may be provided on its end remote from the fuel distributor line 1 with at least two flanges 44 extending away from the pressure regulating valve and approximately parallel to the fuel distributor line. Resting on these flanges 44 remote from the fuel distributor line 1 is at least one retaining body 45, which is connected to the flanges 44 by screws 46. The pressure regulating valve 8 has a larger diameter in the radial direction, in the vicinity of the shoulder 21 and crimped edge 24, than the guide bore 47 of the receiving bush 3, into which the pressure regulating valve 8 is inserted, so that the shoulder 21 rests on the flanges 44. Remote from the flanges 44, the retaining body 45 has an angled step 49, which engages the crimped edge 24 facing the flanges 44 and by means of the screw connection 46 fixes the pressure regulating valve 8 on the flanges 44 in the axial direction. The angled step 49 may be annular and may be provided with an insertion opening 50 through which the cap 20 of the pressure regulating valve protrudes.

Like the cap 20, the intermediate part 18 is preferably of sheet metal, optionally stainless steel, and is embodied as a deep-drawn part. A cylindrical segment 53 of the intermediate part adjoins the shoulder 21 and has approximately the same diameter as the guide bore 47 of the receiving bush 3. A radially inwardly bent securing segment 54 of the intermediate part 18 adjoins the cylindrical segment 53 and rests at least partly on an annular shoulder 55 of the bottom part 19 and is welded or hard-soldered to it in a pressure-tight manner. The securing segment 54 of the intermediate part 18 also defines one side of the sealing groove 42. Both the bottom part 19 and the connection fitting 9 are embodied as rigid by assembled turned parts, so that the valve housing has sufficient dimensional rigidity to maintain long-term functional capacity of the pressure regulating valve.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A pressure regulating valve for a fuel supply system of an internal combustion engine which comprises a valve housing, said valve housing including a rigid bottom part (19), an intermediate part (18) having one end that rests upon said bottom part and a shoulder (21), a cap (20) including a collar (22), a diaphragm (23) secured between said shoulder on said intermediate part and said collar of said cap, said intermediate part including means which secures said cap to said intermediate part, said diaphragm dividing said valve housing to form a spring chamber and a fuel chamber, at least one inflow opening for admitting fuel into said fuel chamber, a one piece outlet fitting (9) secured to said bottom part in axial alignment with said valve housing, said one piece outlet fitting including a passage therethrough and a valve seat on one end thereof, a valve plate secured to said diaphragm in said fuel chamber, said valve plate cooperating with said valve seat on said outlet fitting to close and open said passage in said outlet fitting, and a connection to said cap for subjecting said diaphragm to a pressure differential.

2. A pressure regulating valve as defined by claim 1, in which said cap (20) and said intermediate part (18) are embodied of sheet metal, as deep-drawn parts.

3. A pressure regulating valve as defined by claim 1, in which said bottom part includes a stepped retaining bore (39) formed in stepped fashion, said outlet fitting includes a radially extending shoulder (40) and said shoulder of said outlet fitting (9) is pressed into said stepped retaining bore (39) of the bottom part (19) and is retained in a fixed position by a flanged-over bent rim (41) of said bottom part (19).

4. A pressure regulating valve as defined by claim 2, in which said bottom part includes a stepped retaining bore (39) formed in stepped fashion, said outlet fitting includes a radially extending shoulder (40) and said shoulder of said outlet fitting (9) is pressed into said stepped retaining bore (39) of the bottom part (19) and is retained in a fixed position by a flanged-over bent rim (41) of said bottom part (19).

5. A pressure regulating valve as defined by claim 3, in which said radially extending shoulder is upstream of said valve seat.

6. A pressure regulating valve as defined by claim 4, in which said radially extending shoulder is upstream of said valve seat.

7. A pressure regulating valve as defined by claim 1, which includes a receiving bush (3) secured to a pressure regulating fuel line (1), said receiving bush (3) includes a guide bore (47) which receives said bottom part and said intermediate part, and means secured to said receiving bush for securing said pressure regulator to said receiving bush.

8. A pressure regulating valve as defined by claim 7, in which said bottom part (19) includes an outwardly extending flange and a uniform diameter portion, and a ring seal secured between said outwardly extending flange of said bottom part, said intermediate part and said receiving bush.

9. A pressure regulating valve as defined by claim 8, in which said means secured to said receiving bush for securing said pressure regulator to said receiving bush includes flanges (44) on said receiving bush, at least one retaining body (45) and at least one screw (46).

* * * * *